US005102122A

United States Patent [19]

Piane, Jr. et al.

[11] Patent Number: 5,102,122

[45] Date of Patent: Apr. 7, 1992

[54] EXERCISE APPARATUS

[75] Inventors: Robert A. Piane, Jr., 790 Salem Church Rd., Newark, Del. 19702; James G. Richards, Newark, Del.

[73] Assignees: Robert A. Piane, Jr.; Victoria L. Piane, both of Newark, Del.

[21] Appl. No.: 591,737

[22] Filed: Oct. 2, 1990

[51] Int. Cl.[5] ..... A63B 21/00

[52] U.S. Cl. ..... 482/133; 482/103

[58] Field of Search ..... 272/117, 118, 120, 123, 272/134, 143, DIG. 4

[56] References Cited

U.S. PATENT DOCUMENTS

| | | | |
|---|---|---|---|
| 372,272 | 10/1887 | Murphy | 272/118 |
| 798,114 | 8/1905 | Rosenthal | 272/134 |
| 804,218 | 11/1905 | Fiedler | 272/118 |
| 1,547,268 | 7/1925 | Sotomayor | 272/118 |
| 2,977,120 | 3/1961 | Morris | 272/118 |
| 3,306,611 | 2/1967 | Gaul | 272/118 |
| 3,807,728 | 4/1974 | Chillier | 272/118 |
| 3,820,782 | 6/1974 | Salkeld | 272/118 |
| 4,149,713 | 4/1979 | McLeod | 272/117 |
| 4,176,836 | 12/1979 | Coyle | 272/120 |
| 4,243,219 | 1/1981 | Price | 272/117 |
| 4,257,590 | 3/1981 | Sullivan et al. | 272/117 |
| 4,296,924 | 4/1981 | Anzaldua et al. | 272/117 |
| 4,316,609 | 2/1982 | Silberman | 272/118 |
| 4,344,618 | 8/1982 | Dudley | 272/117 |
| 4,531,727 | 7/1985 | Pitre | 272/117 |
| 4,549,733 | 10/1985 | Salyer | 272/134 X |
| 4,603,855 | 8/1986 | Sebelle | 272/117 |
| 4,632,388 | 12/1986 | Schleffendorf | 272/118 |
| 4,648,594 | 3/1987 | Schelffendorf | 272/118 |
| 4,721,303 | 1/1988 | Fitzpatrick | 272/117 |
| 4,730,829 | 3/1988 | Carlson | 272/134 X |
| 4,826,153 | 5/1989 | Schalip | 272/118 |
| 4,826,154 | 5/1989 | Askonen | 272/118 |
| 4,842,270 | 6/1989 | Lange | 272/117 |
| 4,898,381 | 2/1990 | Gordon | 272/117 |

FOREIGN PATENT DOCUMENTS

| | | | |
|---|---|---|---|
| 7609655 | 3/1978 | Netherlands | 272/117 |

OTHER PUBLICATIONS

Elgin Exercise Equipment Corporation-Des Plaines, Ill.

*Primary Examiner*—Robert Bahr

*Attorney, Agent, or Firm*—Ratner & Prestia

[57] ABSTRACT

Exercise apparatus in which the position of a cable which is drawn against a resistance source can be changed to permit performing a variety of different exercises. A handle or other unit which is attached to the cable is carried by a trolley to various positions along a track which extends along a curved surface of a housing and defines a prescribed curved path. Once the trolley is set in a position along the track for a particular exercise, the cable is drawn against the resistance source.

21 Claims, 6 Drawing Sheets

EXERCISE APPARATUS

TECHNICAL FIELD

The present invention relates, in general, to exercise apparatus of the type in which cables are repeatedly drawn against a resistance source and, in particular, to exercise apparatus which can be set to perform a large variety of different exercises and allows the user the ability to utilize the entire body in full-range exercise, sports-specific motion and work-specific motion. In the first instance, the present invention is adapted to be engaged by the hands of the user. With suitable attachments, the present invention can be adapted for engagement by the legs of the user or by other body parts

BACKGROUND OF THE INVENTION

Many exercise machines have been disclosed or put into actual use in which a cable is drawn against a resistance source by the individual exercising with the machine Typically, these machines include a handle attached to one end of a cable with a resistance source, such as weights, opposing pulling of the cable. Different exercises can be performed by adjusting the vertical position at which the cable leaves the machine. Such adjustability, however, provides only a limited variety of exercises.

U.S. Pat. No. 4,603,855 discloses exercise apparatus in which the handle, grasped by the individual using the apparatus, can undergo three degrees of movement as it is positioned for a selected exercise. Although such apparatus provides added adjustability, whereby many more exercises are possible, the particular arrangement disclosed in this patent, which includes mounting the handle on a telescoping arm, lacks sufficient strength and stability when constructed from conventional components or becomes very expensive to manufacture when special components are used to provide greater strength and stability.

In another exercise apparatus sold by Elgin Exercise Equipment Corporation of Des Plaines, Illinois, the handle grasped by the user is movable to the desired position by a trolley which moves along a curved track. This apparatus also provides added facility for a variety of different exercises. However, the framework support structure of this exercise apparatus also provides only limited strength and stability when constructed from conventional components or becomes very expensive to manufacture when special components are used to provide greater strength and stability. In addition, framework support structures of this type can present certain hazards to the user of the equipment. A snapped cable can emerge from the framework support structure and injure the user. Also, there is inadequate protection against inadvertent exposure of body parts, such as fingers, to certain of the internal working parts of the equipment and this too can lead to injury.

SUMMARY OF THE INVENTION

Exercise apparatus, constructed in accordance with the present invention, includes a housing having a slot extending along a curved surface of the housing and a curved track extending along the slot defining a prescribed curved path. Also included in this exercise apparatus are a trolley movable along the curved track, a universal connector carried by the trolley and movable relative to the trolley, a resistance source within the housing, and means within the housing and extending through the slot in the housing for connecting the universal connector to the resistance source.

Such exercise apparatus is arranged for engagement by one arm or one leg or one body part at a time. If both arms or both legs or one of each or more than one body part are to engage the apparatus simultaneously, two points of force application (i.e. universal connectors), suitably located, are provided and the overall exercise apparatus has two parts. The two parts can be separate units, placed side-by-side, parallel or at selected relative angles, or they can be integrated into a unitary construction. Although in the following description of the present invention reference is made to engagement by and exercise of the arms and legs, by the use of suitable attachments to the universal connectors, other body parts such as the torso, neck, hips, shoulders, chest and back also can be engaged and exercised.

DETAILED DESCRIPTION OF THE INVENTION

Figure 1:
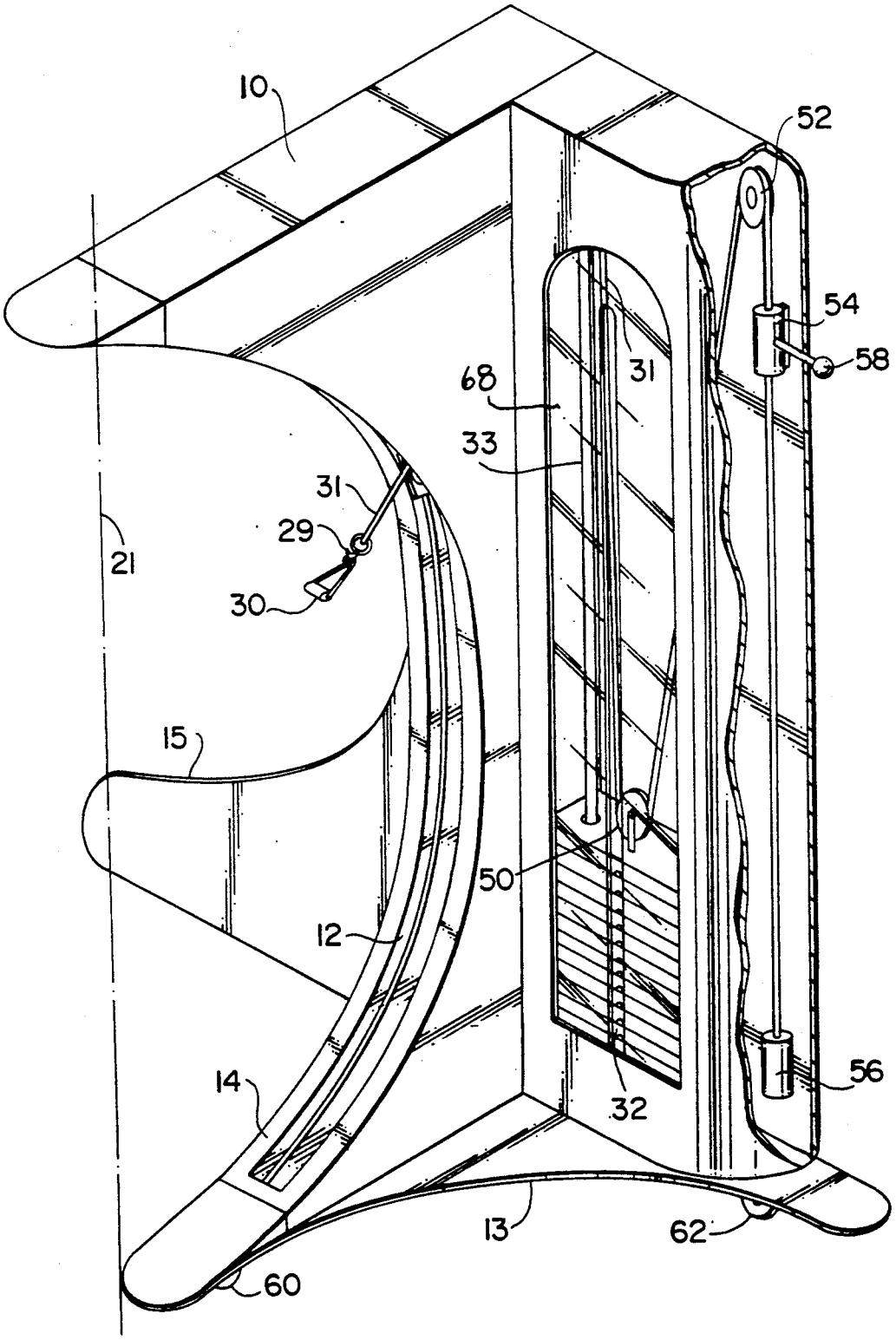
FIG. 1 is a perspective view of a first embodiment of exercise apparatus constructed in accordance with the present invention.

Referring to FIGS. 1, 2, 3A and 3B, exercise apparatus, constructed in accordance with the present invention, includes a housing 10 having a slot 12 extending along a curved surface 14 of housing 10. Housing 10 also has a curved track extending along slot 12 defining a prescribed curved path. For the embodiment of the invention illustrated in FIGS. 1 and 2, the curved track is formed by two parts **16*a* and 16*b* of housing 10 which define curved surface 14. Housing 10 also has various horizontal and vertical members, including a stabilizing floor plate 13 and a stabilizing side wing 15**. The housing parts are joined together by suitable means, such as mechanical fasteners, adhesives or a combination of the two, to result in a strong and stable unit capable of handling the forces applied by an individual using the exercise apparatus.

Exercise apparatus, constructed in accordance with the present invention, also includes a trolley 18 which is movable along curved track **16*a*, 16*b* by means of a pair of plates 20 which slide along the inside surfaces of the housing parts which form the curved track. Plates 20 are held together by a pair of axles 19 which protrude from the plates into slots 17*a* and 17*b* in the sidewalls of curved track parts 16*a* and 16*b*, respectively. Trolley 18 can be moved to any position along the length of curved track 16*a*, 16*b*** which extends over an included angle of approximately 180 degrees and locked in place at a selected position along the curved track by a suitable locking mechanism.

Preferably, curved track 16*a*, 16*b* extends over an included angle of less than 180 degrees from an uppermost point on a vertical line 21 to a lowermost point short of vertical line 21. With such an arrangement of curved track 16*a*, 16*b*, the individual using the exercise apparatus has foot-room and can position himself more within the confines of the exercise apparatus, thereby permitting the performance of a greater range of full-body motions and related exercises than possible with the lowermost point of the curved track on vertical line 21.

Figure 3A:
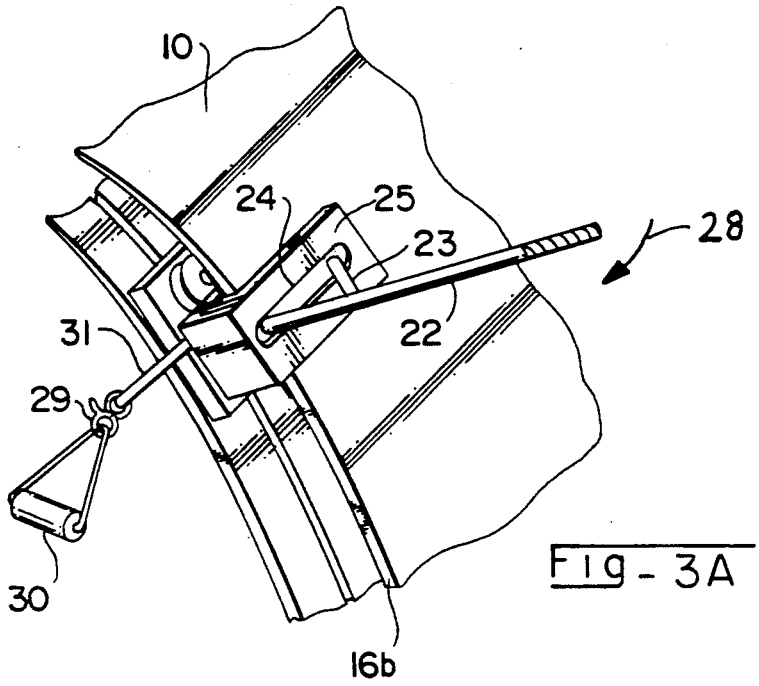
FIGS. 3A and 3B are perspective and horizontal sectional views, respectively, of a portion of the FIGS. 1 and 2 exercise apparatus.
Figure 3B:
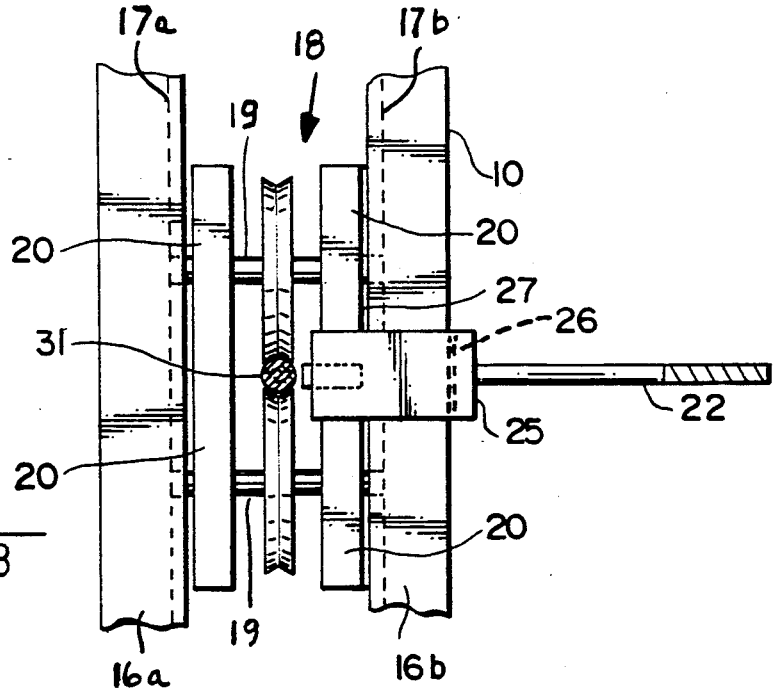

The locking mechanism, illustrated in FIGS. 3A and 3B, includes a handle 22 and a sliding arm 23 which extends from handle 22 to a slot 24 in a bracket 25. Bracket 25 extends around curved track part 16*b* and is attached to trolley 18. Bracket 25 carries a pad 26 and by proper sizing of the bracket, housing 10 is clamped between pad 26 and a pad 27 carried by trolley 18, as illustrated in FIG. 3B, thereby locking the trolley in place. When handle 22 is pulled forward in the direction of arrow 28, the legs of bracket 25 are forced apart causing pads 26 and 27 to move away from the surfaces of housing 10, thereby permitting movement of trolley 18 along curved track 16*a*, 16*b*.

Exercise apparatus, constructed in accordance with the present invention, further includes a universal connector 29 which is carried by trolley 18 and is movable relative to the trolley. Universal connector 29 is arranged to receive a variety of devices by which the individual using the exercise apparatus can perform different exercise. As shown in FIGS. 1 and 3A, a handle 30 is attached to universal connector 29. However, other attachments, such as belts or bars, can be used if the particular exercise for a particular body part or a particular motion calls for a different attachment.

Universal connector 29 is attached to one end of a cable 31 and can be drawn away from trolley 18 when handle 30 is pulled by the person using the exercise apparatus. In accordance with the present invention, a resistance source, positioned within housing 10 and in the form of a weight stack 32, also is connected to cable 31. Other resistance sources, such as pneumatic or hydraulic cylinders, electronic brakes or stepper motors, can be used in this embodiment of the invention and the other embodiments of the invention to be described. Weight stack 32 is guided for up/down movement by a pair of vertical guide posts 33 and 34. By adding or removing weights from the stack, the resistance or load of the exercise can be changed.

Cable 31, which provides the means for connecting universal connector 29 to weight stack 32, also is within housing 10 and extends through slot 12 to the universal connector for all positions of trolley 18 along curved track 16*a*, 16*b*. Cable 31 passes between a first pair of vertically disposed pulleys 36 and 38 carried by trolley 18 to a second pair of vertically disposed pulleys 40 and 42 mounted within housing 10. After passing between pulleys 40 and 42, cable 31 passes over a vertically disposed pulley 44, also mounted within housing 10, to a horizontally disposed pulley 46 which also is mounted within housing 10. After passing around pulley 46, cable 31 passes over a vertically disposed pulley 48, mounted within housing 10, to another vertically disposed pulley 50 which is mounted on the top member of weight stack 32.

In order to accommodate changes in the location of trolley 18 along curved track 16*a*, 16*b*, a preferred embodiment of the present invention includes a cable take-up mechanism located within housing 10. This cable take-up mechanism assures definite lengths of cable between weight stack 32 and universal connector 29 for different positions of trolley 8 by removing slack from cable 31 or providing additional cable length in response to movement of the trolley. In the FIGS. 1 and 2 embodiment of the present invention, the cable take-up mechanism includes an additional length of cable 31 which runs from pulley 50 around another vertically disposed pulley 52 mounted within housing 10 and through a sleeve 54 to a weight 56. Sleeve 54 is mounted on an inside surface of housing 10. With a handle 58 on sleeve 54 loosened, cable 31 slides freely either upwardly through the sleeve against weight 56 as trolley 18 is moved in one direction along curved track 16*a*, 16*b* or downwardly through the sleeve with weight 56 as trolley 18 is moved in the opposite direction along curved track 16*a*, 16*b*. In this way, slack is removed from cable 31 or additional cable length is provided as trolley 18 is moved. When the trolley is at the desired location along track 16*a*, 16*b*, handle 58 is tightened to prevent cable 31 from sliding through sleeve 54, with the result that when handle 29 is pulled by the user, weight stack 32 is lifted immediately.

Figure 2:
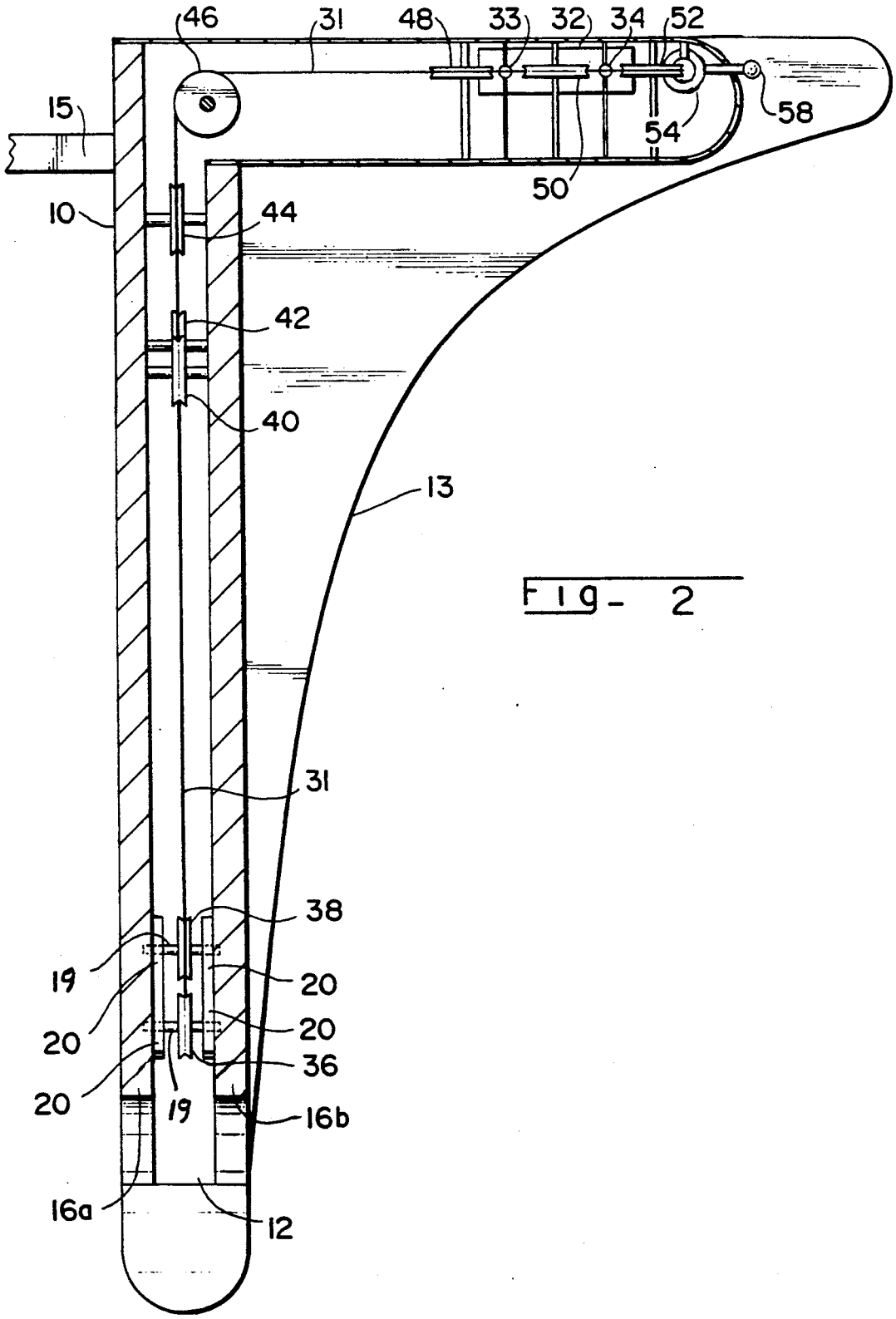
FIG. 2 is a horizontal sectional view of the FIG. 1 exercise apparatus.

The exercise apparatus of FIGS. 1 and 2 can be moved along a floor surface by means of a plurality of retractable wheel units mounted at the bottom of housing 10. Two such wheel units 60 and 62 are shown in FIG. 1. When the exercise apparatus has been moved to the desired location, the wheel units are retracted and the exercise apparatus is lowered to the floor surface.

Access to weight stack 32 is necessary to change the load of the weight stack. Preferably, exercise apparatus of this type permits viewing of the weight stack during exercise. Therefore, the opening in housing 10 which permits access to the weight stack and viewing of the weight stack preferably has a strong plastic cover 68 to protect against injury which might occur if this opening was not covered.

From the foregoing description of the FIGS. 1 and 2 embodiment of the present invention, it is seen that certain of the shortcomings and limitations of the prior art units considered above are greatly reduced, if not overcome. Housing 10 provides added strength and stability in generally the same way as the "skin" of aircraft and other equipment contribute to strength and stability. In addition, with a limited amount of openings in the housing, there is reduced exposure to injury which might be caused, for example, by a snapped cable or access to the working parts of the equipment.

Figure 4:
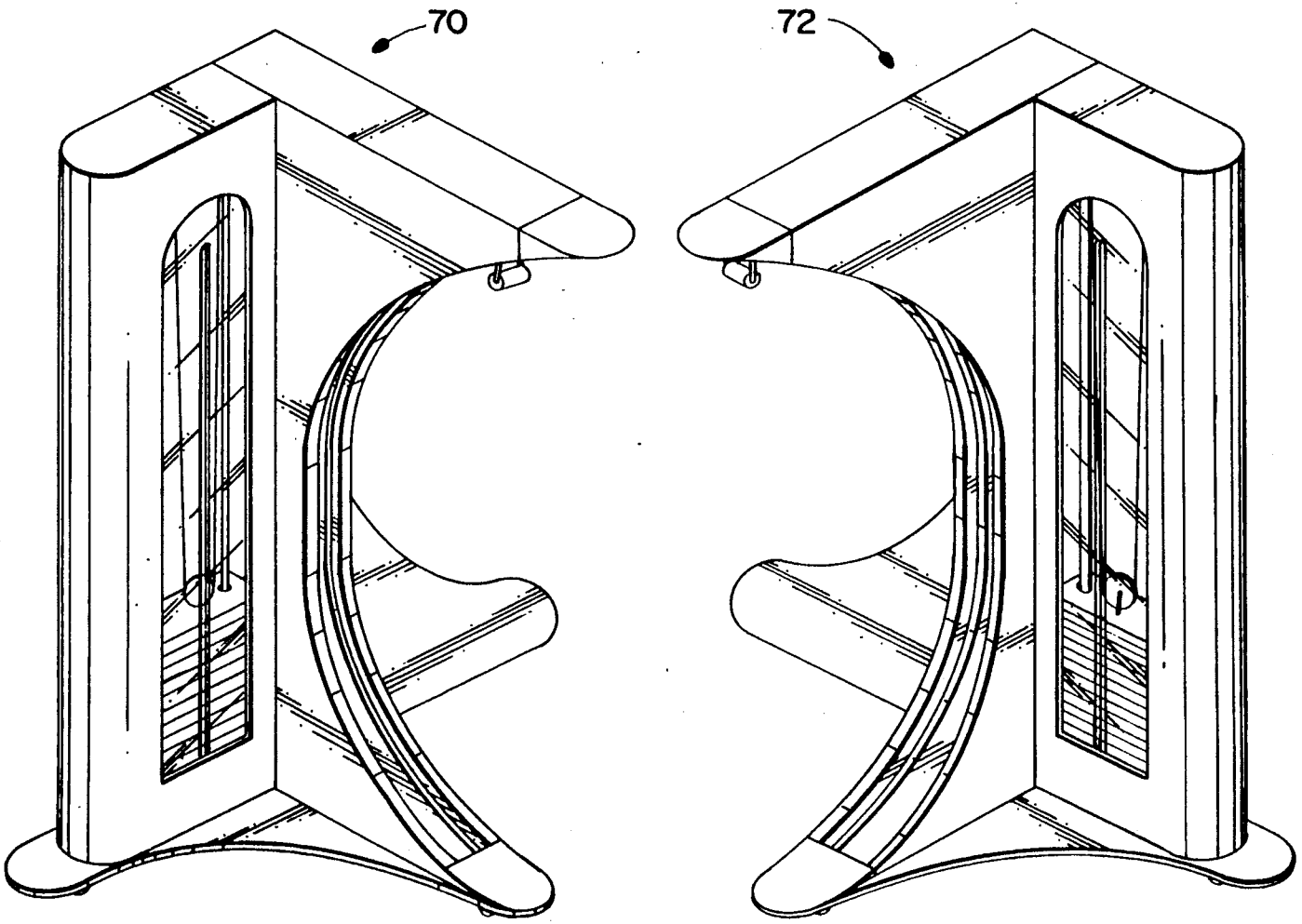
FIG. 4 is a perspective view of a second embodiment of exercise apparatus constructed in accordance with the present invention.

FIG. 4 is a perspective view of a second embodiment of exercise apparatus constructed in accordance with the present invention. The FIG. 4 exercise apparatus includes two units 70 and 72, one identical to the FIGS. 1 and 2 exercise apparatus and the other a mirror image of the first. As a result, with this arrangement, after each unit has been moved to the desired floor location, the individual using the exercise apparatus can engage the exercise apparatus with both arms or both legs or one of each simultaneously.

Figure 5:
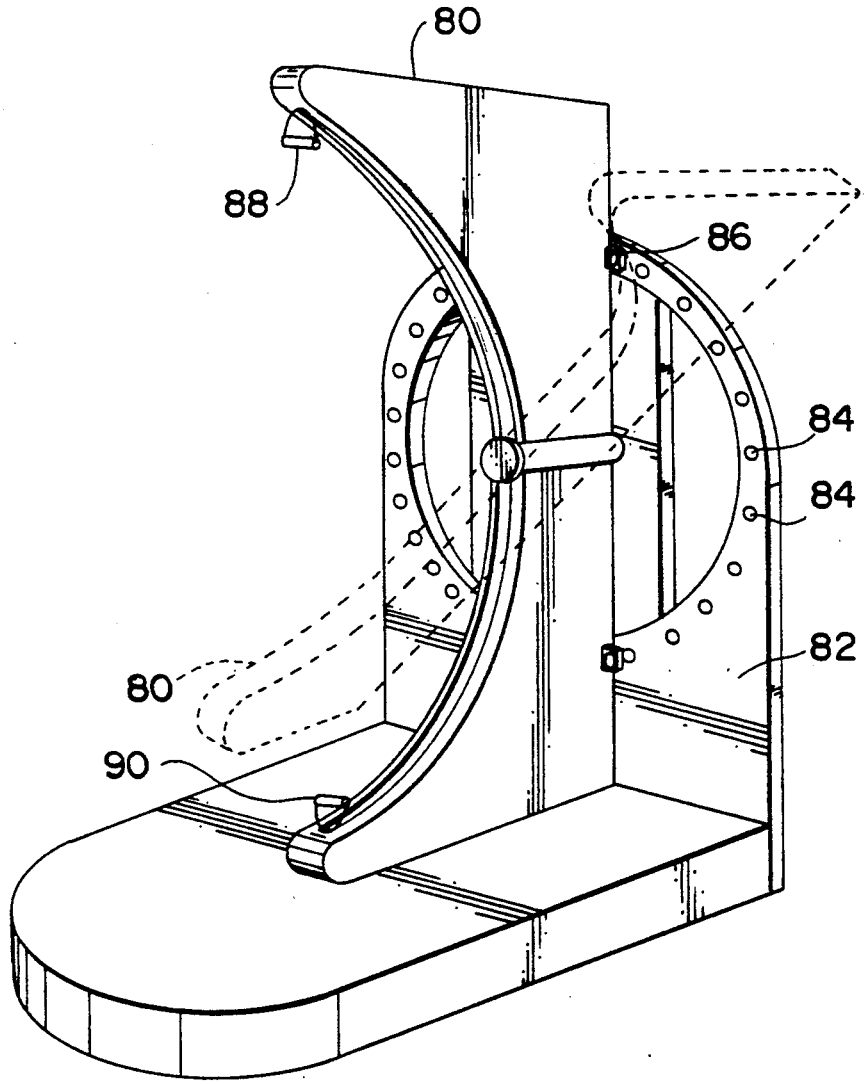
FIG. 5 is a perspective view of a third embodiment of exercise apparatus constructed in accordance with the present invention.

FIG. 5 is a perspective view of a third embodiment of exercise apparatus constructed in accordance with the present invention. In FIG. 5, the curved track is part of a first housing part 80 which is mounted on a second housing part 82 for pivotal movement about a horizontal axis, as represented by the dashed-line position of housing part 80. As housing part 80 pivots, the curved track defines a surface of revolution adding a third degree of movement to the positioning of a trolley movable in the curved track. Housing part 82 has a plurality of holes 84 which can receive one or more lock pins 86, which are carried by housing part 80, to fix housing part 80 in a desired pivotal position.

In addition, an individual can engage the exercise apparatus with both arms or both legs or one of each simultaneously with the FIG. 5 embodiment of the present invention even though there is only one curved track. A pair of handles 88 and 90 are carried by a pair of trolleys which are separately movable along the curved track to desired positions. Each trolley has its own cable and associated pulleys, cable take-up mechanism and resistance source.

The trolleys in the FIG. 5 embodiment can be arranged similar to trolley 18 in the FIGS. 1 and 2 embodiment. Likewise, the resistance sources, the cables and associated pulleys, and the cable take-up mechanisms in the FIG. 5 exercise apparatus can be generally similar to their counterparts in the FIGS. 1 and 2 exercise apparatus.

Figure 6:
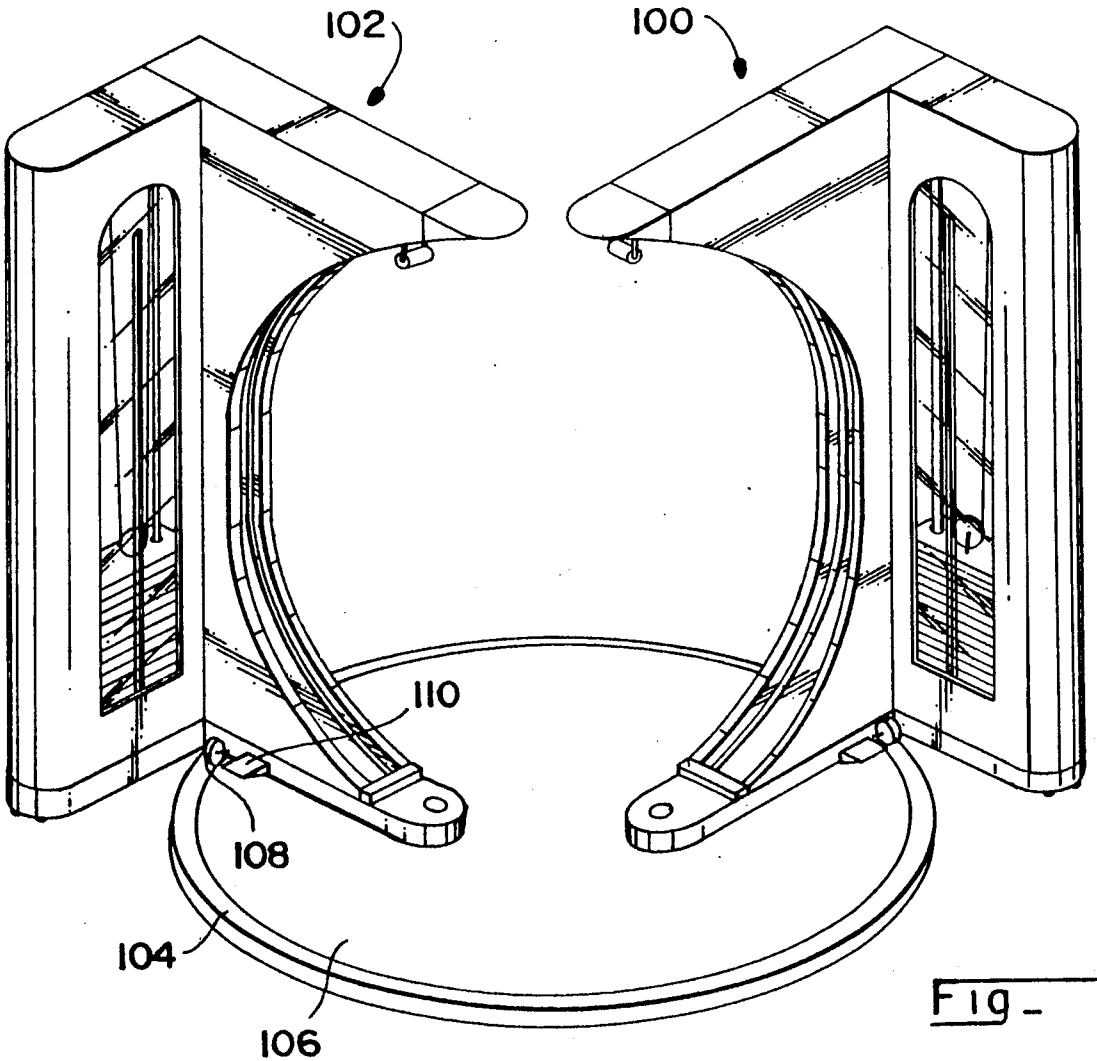
FIG. 6 is a perspective view of fourth embodiment of exercise apparatus constructed in accordance with the present invention.

FIG. 6 is a perspective view of a fourth embodiment of exercise apparatus constructed in accordance with the present invention. In FIG. 6, each of two exercise units 100 and 102 is mounted for movement along a circular track 104 in a base surface 106 by means of one or more track rollers 108. After each unit has been moved to the desired position, it is fixed in place by depressing a foot pedal 110 which locks track roller 108. Then, the individual using the exercise can engage the exercise with both arms or both legs or one of each simultaneously.

While in the foregoing there have been described preferred embodiments of the present invention, it should be obvious to those skilled in the art that various modifications and changes can be made without departing from the true spirit and scope of the invention.

What is claimed:

1. Exercise apparatus comprising:

a housing having:

(a) pair of spaced sidewalls, and (b) a surface between said sidewalls curved along its length and having a slot extending along its length;

a trolley mounted for movement along said curved surface of said housing to selected locations along said curved surface;

a universal connector carried by said trolley and movable relative to said trolley;

a resistance source within said housing;

and connecting means within said housing and extending through said slot in said curved surface of said housing for connecting said universal connector to said resistance source.

2. Exercise apparatus according to claim 1 further including means for locking said trolley at a selected location along said curved surface of said housing.

3. Exercise apparatus comprising:

a housing having:

(a) pair of spaced sidewalls, and (b) a surface between said sidewalls curved along its length and having a slot extending along its length;

a trolley mounted for movement along said curved surface of said housing to selected locatins along said curved surface;

locking means for locking said trolley at a selected location along said curved surface;

a universal connector carried by said trolley and movable relative to said trolley;

a resistance source within said housing;

and connecting means within said housing and extending through said slot in said curved surface of said housing for connecting said universal connector to said resistance source.

4. Exercise apparatus according to claim 3 wherein said connecting means include a cable extending between said universal connector and said resistance source and said exercise apparatus further includes cable take-up means within said housing responsive to movement of said trolley for removing slack from said cable and providing additional cable length when said trolley is moved.

5. Exercise apparatus according to claim 3 further including means for moving said housing along a floor surface to a desired location.

6. Exercise apparatus according to claim 3 further including:

(a) a second trolley mounted for movement along said curved surface of said housing to selected locations along said curved surface, (b) a second universal connector carried by said second trolley and movable relative to said second trolley, (c) a second resistance source within said housing, (d) second connecting means within said housing and extending through said slot in said curved surface of said housing for connecting said second universal connector to said second resistance source, and (e) second locking means for locking said second trolley at a selected location along said curved surface of said housing.

7. Exercise apparatus according to claim 4 wherein said curved surface of said housing extends from an uppermost point on a vertical line to a lowermost point over an included angle of less than 180 degrees.

8. Exercise apparatus comprising:

a first housing having:

(a) a first pair of spaced sidewalls, and (b) a first surface between said first pair of sidewalls curved along its length and having a slot extending along its length;

first moving means for moving said first housing along a floor surface to a desired location;

a first trolley mounted for movement along said first curved surface of said first housing to selected locations along said first curved surface;

first locking means for locking said first trolley at a selected location along said first curved surface;

a first universal connector carried by said first trolley and movable relative to said first trolley;

a first resistance source within said first housing;

first connecting means within said first housing and extending through said slot in said first curved surface of said first housing for connecting said first universal connector to said first resistance source;

a second housing having:

(a) a second pair of spaced sidewalls, and (b) a second surface between said second pair of sidewalls curved along its length and having a slot extending along its length;

second moving means for moving said second housing along a floor surface to a desired location;

a second trolley mounted for movement along said second curved surface of said second housing to selected locations along said second curved surface;

second locking means for locking said second trolley at a selected location along said second curved surface;

a second universal connector carried by said second trolley and movable relative to said second trolley;

a second resistance source within said second housing;

and second connecting means within said second housing and extending through said slot in said second curved surface of said second housing for connecting said second universal connector to said second resistance source.

9. Exercise apparatus according to claim 8 wherein said first connecting means include a first cable extending between said first universal connector and said first resistance source and said second connecting means include a second cable extending between said second universal connector and said second resistance source and said exercise apparatus further includes:

(a) first cable take-up means within said first housing responsive to movement of said first trolley for removing slack from said first cable and providing additional cable length when said first trolley is moved, and (b) second cable take-up means within said second housing responsive to movement of said second trolley for removing slack from said second cable and providing additional cable length when said second trolley is moved.

10. Exercise apparatus according to claim 9 wherein each of said curved surfaces of said housings extends from an uppermost point on a vertical line to a lowermost point over an included angle of less than 180 degrees.

11. Exercise apparatus according to claim 9 wherein said second housing is the mirror image of said first housing.

12. Exercise apparatus comprising:

a track disposed in a base surface;

a first housing having:

(a) a first pair of spaced sidewalls, and (b) a first surface between said first pair of sidewalls curved along its length and having a slot extending along its length;

first mounting means for mounting said first housing for movement along said track in said base surface;

a first trolley mounted for movement along said first curved surface of said first housing to selected locations along said first curved surface;

first locking means for locking said first trolley at a selected location along said first curved surface;

a first universal connector carried by said first trolley and movable relative to said first trolley;

a first resistance source within said first housing;

first connecting means within said first housing and extending through said slot in said first curved surface of said first housing for connecting said first universal connector to said first resistance source;

a second housing having:

(a) a second pair of spaced sidewalls, and (b) a second surface between said second pair of sidewalls curved along its length and having a slot extending along its length;

second mounting means for mounting said second housing for movement along said track in said base surface;

a second trolley mounted for movement along said second curved surface of said second housing to selected locations along said second curved surface;

second locking means for locking said second trolley at a selected location along said second curved surface;

a second universal connector carried by said second trolley and movable relative to said second trolley;

a second resistance source within said second housing;

and second connecting means within said second housing and extending through said slot in said second curved surface of said second housing for connecting said second universal connector to said second resistance source.

13. Exercise apparatus according to claim 12 wherein said first connecting means include a first cable extending between said first universal connector and said first resistance source and said second connecting means include a second cable extending between said second universal connector and said second resistance source and said exercise apparatus further includes first and second cable take-up means responsive to movements of said first and said second trolleys, respectively, for removing slack from said cables and providing additional cable length when said trolleys are moved.

14. Exercise apparatus according to claim 13 wherein each of said mounting means include means for locking said housings at selected positions along said track in said base surface.

15. Exercise apparatus according to claim 14 wherein said track in said base surface is circular.

16. Exercise apparatus according to claim 14 wherein each of said surfaces of said housings extends from an uppermost point on a vertical line to a lowermost point over an included angle of less than 180 degrees.

17. Exercise apparatus according to claim 13 wherein said second housing is the mirror image of said first housing.

18. Exercise apparatus comprising:

a first housing having:

(a) a first pair of spaced sidewalls, and (b) a first surface between said first pair of sidewalls curved along its length and having a slot extending along its length;

first moving means for moving said first housing along a floor surface to a desired location;

a first trolley mounted for movement along said first curved surface of said first housing to selected locations along said first curved surface;

a first universal connector carried by said first trolley and movable relative to said first trolley;

a first resistance source within said first housing;

first connecting means within said first housing and extending through said slot in said first curved surface of said first housing for connecting said first universal connector to said first resistance source;

a second housing having:

(a) a second pair of spaced sidewalls, and (b) a second surface between said second pair of sidewalls curved along its length and having a slot extending along its length;

second moving means for moving said second housing along a floor surface to a desired location;

a second trolley mounted for movement along said second curved surface of said second housing to selected locations along said second curved surface;

a second universal connector carried by said second trolley and movable relative to said second trolley;

a second resistance source within said second housing;

and second connecting means within said second housing and extending through said slot in said second curved surface of said second housing for connecting said second universal connector to said second resistance source.

19. Exercise apparatus according to claim 18 further including:

(a) first locking means for locking said first trolley at a selected location along said first curved surface of said first housing, and (b) second locking means for locking said second trolley at a selected location along said second curved surface of said second housing.

20. Exercise apparatus comprising:

a first housing having a slot extending along a curved surface of said housing and a curved track extending along said slot defining a prescribed curved path;

a trolley movable along said curved path;

a universal connector carried by said trolley and movable relative to said trolley;

a resistance source within said housing;

means within said housing and extending through said slot in said housing for connecting said universal connector to said resistance source;

a second housing;

means for mounting said first housing on said second housing for pivotal movement about a horizontal axis to define a surface of revolution by said curved track as said curved track is pivoted about said horizontal axis;

and means for locking said first housing at a selected pivotal position of said first housing.

21. Exercise apparatus comprising:

a first housing having a slot extending along a curved surface of said housing and a curved track extending along said slot defining a prescribed curved path;

a trolley movable along said curved path;

a universal connector carried by said trolley and movable relative to said trolley;

a resistance source within said housing;

a cable extending from within said first housing through said slot between said universal connector said resistance source;

cable take-up means within said first housing responsive to movement of said trolley for removing slack from said cable and providing additional cable length when said trolley is moved;

a second housing;

means for mounting said first housing on said second housing for pivotal movement about a horizontal axis to define a surface of revolution by said curved track as said curved track is pivoted about said horizontal axis;

and means for locking said first housing at a selected pivotal position of said first housing.

* * * * *